United States Patent [19]

Kirberger

[11] Patent Number: 5,040,261

[45] Date of Patent: Aug. 20, 1991

[54] GRIPPING SLIDE FOR A TOOTHBRUSH HANDLE

[75] Inventor: Robert R. Kirberger, Wallmerod, Fed. Rep. of Germany

[73] Assignee: Blendax GmbH, Fed. Rep. of Germany

[21] Appl. No.: 429,741

[22] Filed: Oct. 31, 1989

[30] Foreign Application Priority Data

Mar. 3, 1988 [DE] Fed. Rep. of Germany ..... 3806889

[51] Int. Cl.[5] ..... A46B 5/02

[52] U.S. Cl. ..... 15/167.1; 15/143 R; 15/246

[58] Field of Search ..... 15/167.1–167.3, 15/143 R, 159 R, 159 A, 160, 106, 186–188, DIG. 5, 143 B, 144 B, 246, 172; 211/65, 66; 248/37.3, 110, 111

[56] References Cited

U.S. PATENT DOCUMENTS

| | | | |
|---|---|---|---|
| Re. 22,938 | 11/1947 | Kisky | 15/167 |
| 759,490 | 5/1904 | Yates . | |
| 1,131,863 | 3/1915 | Phillips | 15/145 |
| 1,327,807 | 1/1920 | Burleigh . | |
| 1,635,924 | 7/1927 | Buckley | 15/210 R |
| 1,796,001 | 3/1931 | Church . | |
| 1,928,328 | 9/1933 | Carpentier | 15/167.1 |
| 2,083,217 | 6/1937 | Brothers et al. | 15/167 |

(List continued on next page.)

FOREIGN PATENT DOCUMENTS

| | | | |
|---|---|---|---|
| 77944 | 9/1949 | Czechoslovakia | 15/167.1 |
| 260612 | 10/1912 | Fed. Rep. of Germany . | |
| 283892 | 4/1915 | Fed. Rep. of Germany . | |
| 554155 | 7/1932 | Fed. Rep. of Germany . | |
| 2402785 | 7/1975 | Fed. Rep. of Germany . | |
| 3414623 | 10/1984 | Fed. Rep. of Germany . | |
| 8622144 | 7/1987 | Fed. Rep. of Germany . | |
| 3612108 | 10/1987 | Fed. Rep. of Germany . | |
| 3805326 | 9/1988 | Fed. Rep. of Germany . | |
| 8903911.4 | 6/1989 | Fed. Rep. of Germany . | |
| 552210 | 11/1925 | France | 15/145 |
| 599790 | 1/1926 | France | 15/145 |
| 606938 | 6/1926 | France | 15/176.2 |
| 1247433 | 10/1960 | France . | |
| 1542567 | 9/1968 | France | 15/143 R |
| 485723 | 10/1953 | Italy | 15/143 R |
| 53-29846 | 3/1978 | Japan . | |
| 1005334 | 9/1965 | United Kingdom | 15/172 |
| 1164597 | 9/1969 | United Kingdom | 15/167.1 |
| 2097245 | 11/1982 | United Kingdom . | |
| 8781 | 6/1984 | United Kingdom | 15/145 |

OTHER PUBLICATIONS

Copending commonly assigned U.S. patent application of H. D. Mierau, I. Tegtmeier, S. N. 272,745 filed Oct. 25, 1988.

Copending commonly assigned U.S. patent application of R. P. Kirberger, S. N. 446,962 filed Dec. 6, 1989.

Co-pending commonly assigned U.S. patent application of Klaus Bartsch, Serial No. 440,822 filed on Nov. 22, 1989—Toothbrush with a Deflecting Part Having a Deflection Profile.

*Primary Examiner*—Harvey C. Hornsby
*Assistant Examiner*—C. E. Cooley
*Attorney, Agent, or Firm*—Michael E. Hilton; John V. Gorman; Richard C. Witte

[57] ABSTRACT

The invention relates to a toothbrush, comprising a brush handle (1) and a brush head (3) adjoining the latter, and, if required, disposed at an angle. According to the invention, a gripping slide (4) which can be displaced over at least part of the length of the brush handle (1) by virtue of a guide element projecting into a handle recess is arranged on the brush handle (1).

1 Claim, 1 Drawing Sheet

U.S. PATENT DOCUMENTS

Figure 1:
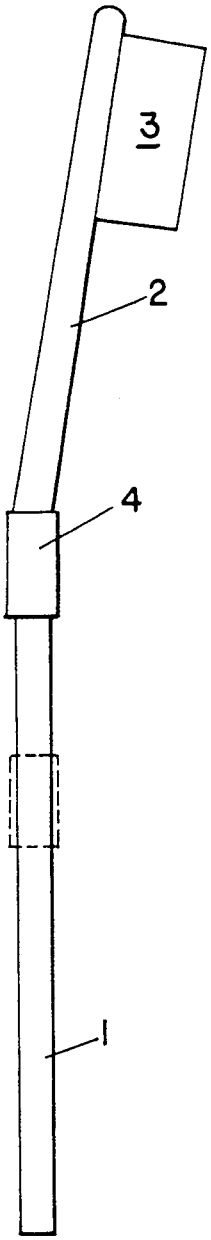

| | | | |
|---|---|---|---|
| 2,139,094 | 12/1938 | Opolo | 74/523 |
| 2,179,266 | 11/1939 | Lukenbill | 15/167.1 |
| 2,219,753 | 10/1940 | Seguin | 15/188 |
| 2,254,365 | 9/1941 | Griffith et al. | 15/167.1 |
| 2,416,684 | 3/1947 | Fischer | 15/138 |
| 2,445,657 | 7/1948 | Bennett | 15/167 |
| 2,517,045 | 8/1950 | Soule | 15/167.1 |
| 2,631,320 | 3/1953 | Bressler | 15/167 |
| 2,677,842 | 5/1954 | Sherwin | 15/210 R |
| 2,835,912 | 5/1958 | Pensky | 15/167.1 |
| 3,691,587 | 9/1972 | Makowsky | 15/172 |
| 3,902,272 | 9/1975 | Molenaar | 46/189 |
| 3,968,950 | 7/1976 | Gallo | 248/359 |
| 4,131,967 | 1/1979 | Northemann et al. | 15/167 |
| 4,253,212 | 3/1981 | Fujita | 15/167 |
| 4,259,761 | 4/1981 | Earle | 15/167.1 |
| 4,461,053 | 7/1984 | Nitzsche et al. | 15/172 |
| 4,476,604 | 10/1984 | White et al. | 15/105 |
| 4,520,526 | 6/1985 | Peters | 15/167 |
| 4,654,922 | 4/1987 | Chen | 15/172 |
| 4,667,360 | 5/1987 | Marthaler et al. | 15/167 |
| 4,691,404 | 9/1987 | Tarrson et al. | 15/167.1 |
| 4,691,405 | 9/1987 | Reed | 15/201 |
| 4,829,621 | 5/1989 | Phenegar | 15/172 |
| 4,864,676 | 9/1989 | Schaiper | 15/167 |

GRIPPING SLIDE FOR A TOOTHBRUSH HANDLE

The invention relates to a toothbrush, comprising a brush handle and a brush head adjoining the latter.

Toothbrushes of this kind usually have an elongate, flat brush handle, directly adjoining which there is, at an angle, a brush head or a connecting web carrying the brush head.

Known toothbrushes sometimes have hollows or projections on the lower and/or upper flat side of the brush handle, in which or against which the index finger and/or thumb are supported in handling the toothbrush while cleaning the teeth. Since adults, young adults and children have fingers of different sizes and hence gripping positions other than those which are predetermined by the fixed projections or hollows would be a good idea, and a movable gripping member would make the handling of the toothbrush considerably easier since, at present, the only possibility available is to buy small or large toothbrushes, hence awkwardness in the handling of the known toothbrushes is accepted.

DE-U 8,622,144 has already disclosed a toothbrush which, in a guide groove in the toothbrush handle, has a grip piece which can be adjusted in the longitudinal direction and is preferably provided with an ergonomic profiling. This construction has considerable disadvantages in terms of production technology since, by reason of its complicated structure, it is expensive to produce and this leads to considerable disadvantages in terms of competitiveness in the case of mass-produced articles such as toothbrushes.

It is therefore the object of the invention to make available a toothbrush of the type mentioned at the outset which, irrespective of the age of the user and the size of his/her fingers, guarantees an optimum gripping position in terms of ergonomics, has a simple structure and can therefore also be produced economically. This object is achieved by a toothbrush having the features of Claim 1.

To increase the friction and for the purpose of a straight-line tilt-free displacement of the gripping slide on the brush handle, the gripping slide and/or the brush handle preferably have guide elements which serve to provide mutual guidance.

A preferred embodiment consists in the gripping slide not having a closed cross-section and its free ends being under prestress to such an extent that it is held clamped on the brush handle.

Figure 2:
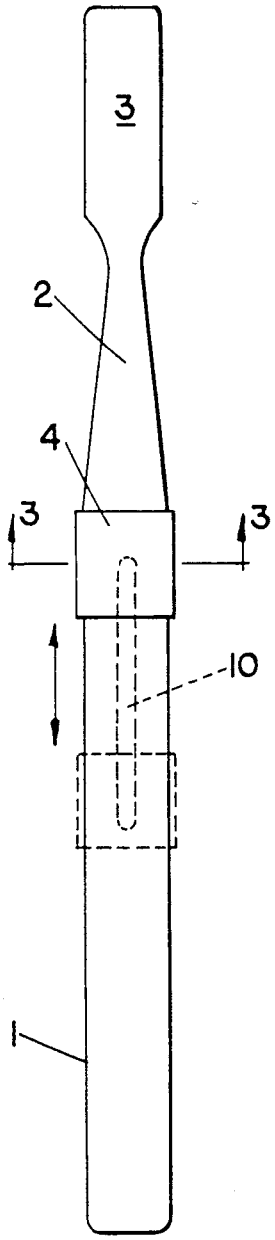
Figure 3A:
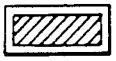
Figure 3B:
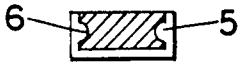
Figure 3C:
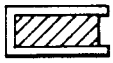
Figure 3D:
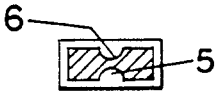
Figure 3E:
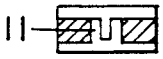
Figure 3F:
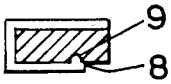
Figure 3G:
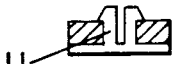
Figure 3H:
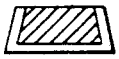
Figure 3I:
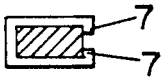
Figure 3J:
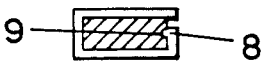

The invention is explained in greater detail below by means of exemplary embodiments with reference to drawings, in which, in schematic representation, FIG. 1 shows a toothbrush according to the invention, in side view, FIG. 2 shows a plan view of the back of the toothbrush, FIGS. 3*a–j* show cross-sections along line III—III in FIG. 2 of different exemplary embodiments, the cross-sections of the respective brush handles being hatched.

FIGS. 4*a–f* show plan views of upper and/or lower sides, and, in some cases, also of the side faces of various gripping slide variants.

The toothbrush represented in FIGS. 1 and 2 has a brush handle 1. The brush handle 1 has a rectangular cross-section with parallel edges. An intermediate member 2 which carries the brush head 3 adjoins one end of the brush handle 1 at an angle. A gripping slide 4 is mounted displaceably on the brush handle 1.

Various exemplary embodiments of the invention are represented in section in FIG. 3, the brush handle 1 being shown hatched. The embodiment of the gripping slide according to FIGS. 3*a* and *d* has a profile which is closed on all sides. Such gripping slides 4 must be pushed on from the free end of the brush handle 1.

Figure 4A:
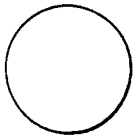
Figure 4B:
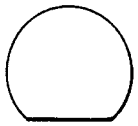
Figure 4C:
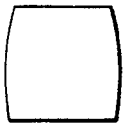
Figure 4D:
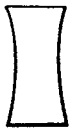
Figure 4E:
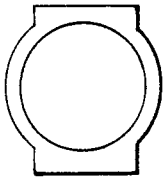
Figure 4F:
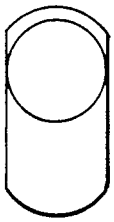

Further embodiments of the gripping slide 4 can be of U-shaped design and be capable of being mounted or pushed onto the brush handle 1 from the side or from above or from below (see FIGS. 4*b, c*). The legs with the free ends of the U-shaped gripping slides 4 can be under prestress, so that, during mounting on the brush handle 1, the legs are moved apart somewhat and consequently, after pushing on, are seated with a clamping fit on the brush handle. In order to prevent unintentional removal of the gripping slide 4 from the brush handle 1, the gripping slides 4 can have inward-directed guide strips 5 which can be introduced into correspondingly shaped and associated longitudinal grooves 6 in the brush handle 1. The free ends of the legs can also have snap-on projections 7 (see FIG. 3*i*) which are supported on the fourth side of the brush handle 1. There is also the possibility of designing gripping slides with an open, unsymetrical outline and then to provide inward-projecting edges 8 (see FIGS. 3*f* and *j*) which can be introduced into a correspondingly shaped and associated groove 9 in the brush handle 1. A sufficiently firm grip of the gripping slide 4 on the brush handle 1 against unintentional displacement and pulling off is ensured by this solution. In addition, this possibility provides opportunities for imaginative design work since, as a result, the brush handle and the sides of the slide can be shaped more freely in order to enable the toothbrushes to be given a more individual style. In the exemplary embodiment according to FIG. 3*h*, the U-shaped gripping slide has flanks which slope at an angle with respect to one another, in which case the cross-section of the brush handle 1 can be trapezoidal. There is also the possibility of providing a longitudinal slot 10 in the brush handle 1 (indicated by a dotted line in FIG. 2). A gripping slide according to FIG. 3*e* and assembled like a pushbutton, or a gripping slide provided with deflectable snap-on projections, according to FIG. 3*g*, can be guided with their respective shanks 11 into this longitudinal slot 10. The slot 10 determines the maximum travel.

For the sake of simplicity, the brush handles illustrated are designed essentially with a rectangular cross-section. However, it is also possible to provide any other rounded, triangular, or polygonal outer cross-sections in the case of the brush handles 1 and provide corresponding inner cross-sections in the case of the gripping slides which can be moved on the latter. As can be seen from FIGS. 1 and 2, the gripping slide 4 itself can have simple rectangular faces. However, it is also possible to provide its upper face and, if required, also its lower face and the side faces with a different shape, as can be seen, for example, from FIGS. 4*a–d*, where circular, partially circular, convex or concave shapes or elongate gripping slides having cut-out open circular faces or buttons, according to FIGS. 4*e* and 4*f*, which are inserted into the gripping sides and are, for example, of a different colour.

Any desired combinations are also possible. The faces of the gripping slide 4 can be arched but also structured, e.g. fluted. It is also possible to provide the gripping slides with projections or depressions, in which the widest possible variety of decorative and/or identifying and/or advertising plates, buttons or arched elements can be affixed, and if required, interchangeably affixed. By virtue of this and by virtue of the gripping slide itself, wide colour design possibilities are provided, since the toothbrush handle and gripping slide and, if required, the inserted plate or the like can have different colours, something which is otherwise only possible with considerably technical expenditure in the case of conventional toothbrushes.

Since the gripping position of the gripping slide on the brush handle, once established, is retained for a prolonged period, the gripping slide and/or, in a corresponding fashion, also the brush handle are to be shaped such that it is difficult to move them with respect to one another, this being achievable by the choice of material and/or structure and/or small dimensional tolerances and/or relatively high clamping forces.

What is claimed is:

1. A toothbrush, comprising a brush handle having a recess; a brush head adjoining the brush handle; and a one piece gripping slide adapted to provide finger support and having an open cross-section partially surrounding the brush handle and a free end under prestress such that the free end is deflected as the gripping slide is attached to the brush handle and once attached, the free end returns toward its undeflected position, to hold the gripping slide on the brush handle; the gripping slide includes a guide element extending from the free end of the gripping slide which projects into the recess on the brush handle such that the guide element is axially moveable over only a predetermined length of the brush handle.

* * * * *

UNITED STATES PATENT AND TRADEMARK OFFICE

CERTIFICATE OF CORRECTION

PATENT NO. : 5,040,261

DATED : Aug. 20, 1991

INVENTOR(S) : Robert R. Kirberger

It is certified that error appears in the above-identified patent and that said Letters Patent is hereby corrected as shown below:

Column 2, line 64, "sides" should read -- slides -- .

Signed and Sealed this

Second Day of March, 1993

*Attest:*

STEPHEN G. KUNIN

*Attesting Officer*

*Acting Commissioner of Patents and Trademarks*